United States Patent [19]

Yuzawa et al.

[11] Patent Number: 4,630,016

[45] Date of Patent: Dec. 16, 1986

[54] ELECTROMAGNETIC RELAY

[75] Inventors: Shigetoshi Yuzawa; Muneo Nakata, both of Iida, Japan

[73] Assignee: Omron Tateisi Electronics Co., Kyoto, Japan

[21] Appl. No.: 750,109

[22] Filed: Jun. 28, 1985

[30] Foreign Application Priority Data

Jun. 30, 1984 [JP] Japan ..... 59-99049[U]

[51] Int. Cl.[4] ..... H01H 51/22

[52] U.S. Cl. ..... 335/81; 335/83

[58] Field of Search ..... 335/81, 79, 78, 80, 335/82, 83, 84, 85, 177–184

[56] References Cited

U.S. PATENT DOCUMENTS 4,529,952 7/1985 Nagamoto et al. ..... 335/81

4,560,966 12/1985 Nagamoto et al. ..... 335/81

*Primary Examiner*—Harold Broome

*Attorney, Agent, or Firm*—Wegner & Bretschneider

[57] ABSTRACT

An improved electromagnetic relay in which movable contact pieces of contact mechanisms are fitted into grooves formed in arm portions of a movable base for a movable block, while small projections formed on the movable contact pieces are fitted into recesses further formed in the grooves so as to fix the movable base to the movable contact pieces without any positional displacement or deviation for the prevention of various characteristic variations resulting from such deviation so as to maintain stable working characteristics over a long period.

2 Claims, 3 Drawing Figures

ELECTROMAGNETIC RELAY

BACKGROUND OF THE INVENTION

The present invention generally relates to an electrical relay and more particularly, to an electromagnetic relay for use in electrical equipment and appliances.

Conventionally, in the field of electromagnetic relays of the above described type, there has been proposed, for example, in Japanese Laid-open Utility Model Application Jikkaisho No. 59-9455, an electromagnetic relay which includes an electromagnet portion having an iron core in the form of a rod around which a coil is wound, a movable block including a movable base on which a pair of movable iron pieces are mounted, with a permanent magnet being held therebetween, and adapted to be movable in a direction intersecting at right angles with respect to a longitudinal direction of the iron core by disposing the movable iron pieces to confront magnetized faces at opposite sides of said iron core, and contact mechanisms to be driven for opening and closing, based on the movement of said movable block.

In the known arrangement as described above, however, since movable contact pieces of the contact mechanism are merely fitted into grooves formed in the movable base, although the movable base is fixed in the moving direction thereof, it is not fixed in the longitudinal direction of the movable pieces. i.e., in the longitudinal direction of the iron core, thus resulting in a possibility that the movable base may be positionally displaced or deviated in the longitudinal direction of the movable pieces during use. When the deviation as described above takes place, there will be invited such disadvantages that the movable iron pieces are attracted onto the magnetized faces in an inclined state, or magnetic characteristics are altered due to different contact areas between the iron core and movable iron pieces, or pressure at the contacts are undesirably varied due to variation in the working stroke of the movable contacts.

SUMMARY OF THE INVENTION

Accordingly, an essential object of the present invention is to provide an improved electromagnetic relay in which a movable base can be fixed to movable contact pieces without any positional diaplacement or deviation, whereby various characteristic variations resulting from such deviation may be advantageously prevented so as to maintain stable working characteristics over a long period.

Another important object of the present invention is to provide an electromagnetic relay of the above described type which is simple in construction and accurate in functioning, and can be readily manufactured on a large scale at low cost.

In accomplishing these and other objects, according to one preferred embodiment of the present invention, there is provided an electromagnet relay which comprises an electromagnet portion having a rod-like iron core around which a coil is wound, a movable block including a movable base on which a pair of movable iron pieces are mounted, with a permanent magnet being held therebetween, and adapted to be movable in a direction intersecting at right angles with a longitudinal direction of the iron core by disposing the movable iron pieces to confront magnetized faces at opposite sides of said iron core, and contact mechanisms to be driven for opening and closing based on the movement of said movable block, and is characterized in that there are further provided movable contact pieces of the contact mechanisms fitted into grooves formed in arm portions of said movable base, small projections formed on said movable contact pieces, and recesses which are formed in said grooves and in which said small projections are fitted.

By the arrangement according to the present invention as described above, an improved electromagnetic relay has been advantageously presented, with the positional deviation of the movable base in the longitudinal direction of the iron core being positively prevented by the fitting between the small projections of the movable contact pieces and the corresponding recesses in the grooves.

BRIEF DESCRIPTION OF THE DRAWINGS

These and other objects and features of the present invention will become apparent from the following description taken in conjunction with the preferred embodiment thereof with reference to the accompnying drawings, in which.

DETAILED DESCRIPTION OF THE INVENTION

Figure 1:
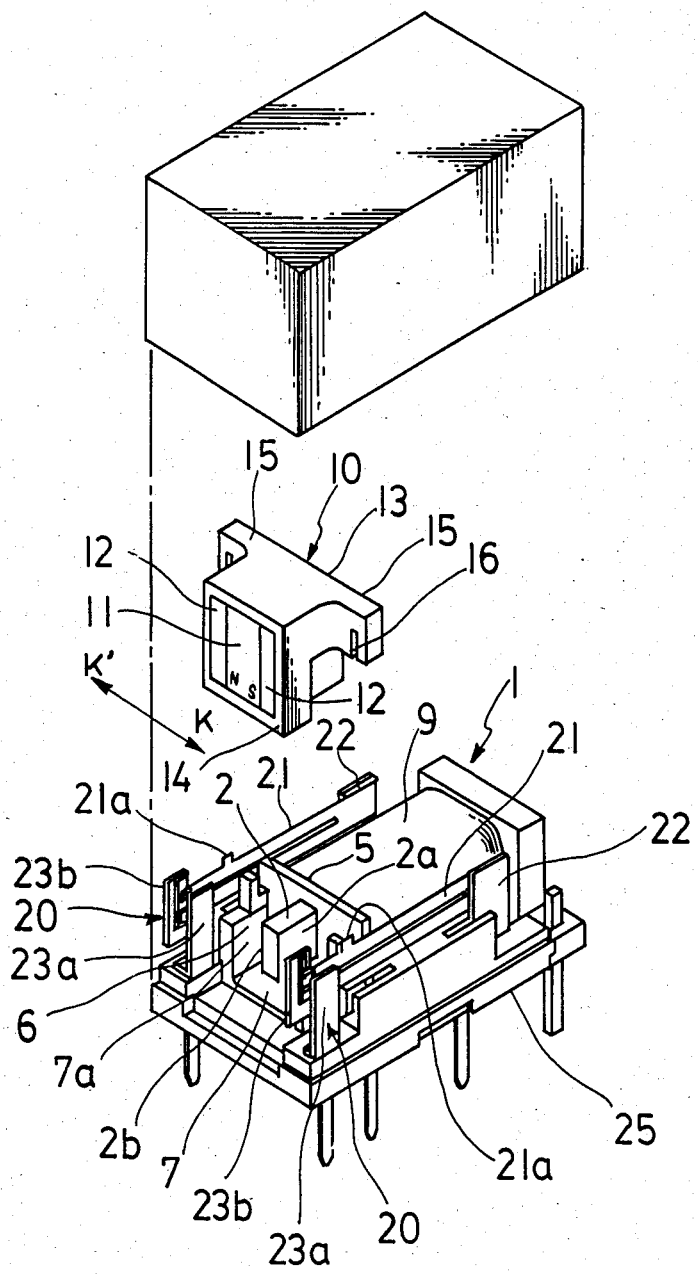
FIG. 1 is an exploded perspective view of an electromagnetic relay according to one preferred embodiment of the present invention.
Figure 2:
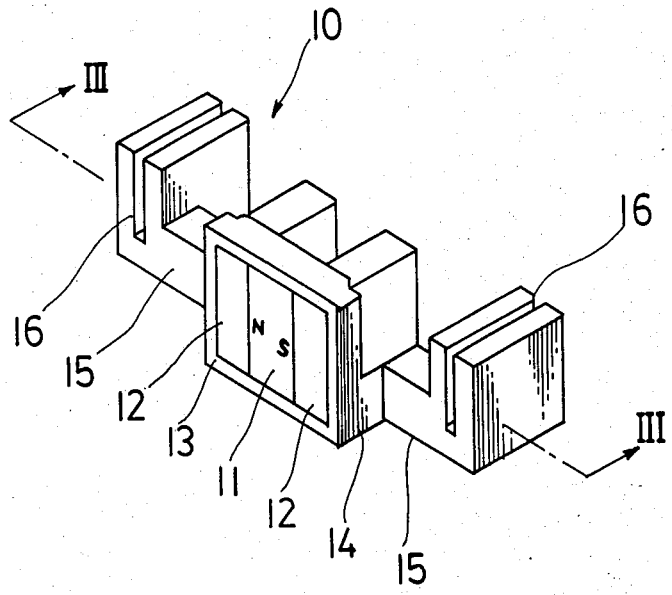
FIG. 2 is a perspective view showing, on an enlarged scale, a movable block as observed from its bottom side, employed in the electromagnetic relay in FIG. 1.

Before the description of the present invention proceeds, it is to be noted that like parts are designated by like reference numerals throughout the accompanying drawings.

Referring now to the drawings, there is shown in FIG. 1, an electromagnetic relay according to one preferred embodiment of the present invention which generally comprises an electromagnet portion 1 having a rod-like iron core 2 around which a coil is wound, a movable block 10 including a movable base 13 on which a pair of movable iron pieces 12 are mounted, with a permanent magnet 11 being held therebetween, and adapted to be movable in a direction intersecting at right angles with a longitudinal direction of the iron core 2 by disposing the movable iron pieces 12 to confront magnetized faces **2*a* and 2*b* at opposite sides of said iron core 2, and contact mechanisms 20 to be driven for opening and closing based on the movement of said movable block 10**.

The above electromagnetic relay of the present invention is particularly characterized in that there are further provided movable contact pieces 21 of the contact mechanisms 20 fitted into grooves 16 formed in arm portions 15 of said movable base 13, small projections **21*a* formed on said movable contact pieces 21, and recesses 17 which are formed in said grooves 16 and in which said small projections 21*a*** are fitted as described in more detail hereinbelow.

The electromagnet portion 1 is constituted by inserting the iron core 2 in the form of a rod into a central bore of a spool 5, with the end portion thereof being secured to a yoke 7. Erected pieces **7*a* formed at opposite ends (only one side of the erected pieces 7*a* is shown in FIG. 1) of the yoke 7 are adapted to confront the magnetized or magnetic pole faces 2***a* and 2*b* at the forward end of the iron core 2, and the spool 5 is provided with the coil 9 wound thereonto as shown.

The movable block 10 is constituted by mounting the movable iron pieces 12 holding the permanent magnet 11 therebetween, onto a frame portion 14 of the movable base 13, and said movable base 13 is provided so as to be movable in the direction intersecting at right angles with the longitudinal direction of the iron core 2, i.e., in the direction indicated by arrows K—K′ (FIG. 1), with the arm portions 15 of said movable base 13 being located within recesses 6 in the spool 5.

Figure 3:
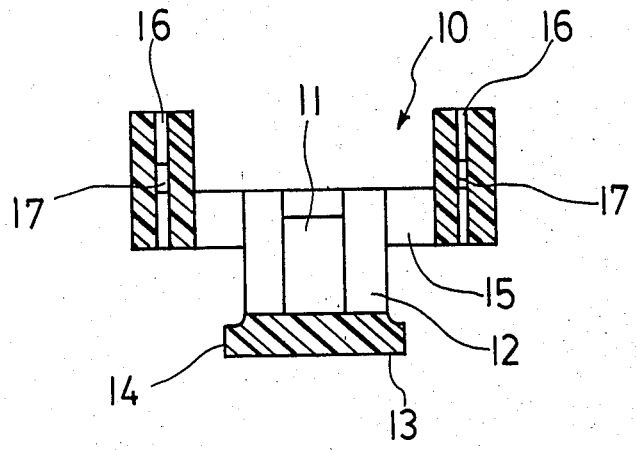
FIG. 3 is a cross section taken along the line III—III in FIG. 2.

Meanwhile, each of the contact mechanisms 20 provided at opposite sides of a base member 25 for the electromagnet relay one set by one set, includes the movable contact piece 21 fixed at its rear end to a terminal 22 provided at one side on the base member 25, while a movable contact provided at the forward end of the movable contact piece 21 is located between stationary contacts provided on a pair of spaced stationary terminals 23*a* and 23*b* disposed at the other side of the base member 25. Moreover, the movable contact pieces 21 are respectively fitted into the corresponding grooves 16 formed in the arm portions 15 of the movable base 13, and in this case, the small projections 21*a* formed on the movable contact pieces 21 are fitted into the recesses 17 (FIG. 3) further formed in said grooves 16.

In other words, by the above arrangement, the movable base 13 is prevented from positional deviation not only in the direction of the arrows K—K′ by the fitting thereof with respect to the movable contact pieces 21 themselves, but also in the longitudinal direction of the movable contact pieces 21, i.e., in the direction intersecting at right angles with the direction of the arrows K—K′ by the fitting between the small projections 21*a* and the recesses 17.

In the above arrangement, functionings of the electromagnetic relay of the present invention are generally similar to those in the conventional electromagnetic relays of the same type. More specifically, during non-excitation of the coil 9, the movable base 13 has been returned, for example, in the direction of the arrow K′, while upon excitation of the coil 9, said movable base 13 is displaced in the direction of the arrow K, and based on these reciprocating movements, the movable contacts selectively open or close the stationary contacts at opposite sides.

As is clear from the foregoing description, according to the present invention, since the small projections of the movable contact pieces are adapted to be fitted into the corresponding recesses of the movable base, the movable base is free from any positional deviation in the longitudinal direction of the iron core, without such inconveniences as the inclination of said movable base, variations in the magnetic characteristics and alterations of pressure at the contacts, etc., thus providing stable working characteristics over a long period.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. In an electromagnetic relay which comprises an electromagnet portion having a rod-like iron core around which a coil is wound, a movable block including a movable base on which a pair of movable iron pieces are mounted, with a permanent magnet being held therebetween, and adapted to be movable in a direction intersecting at right angles with a longitudinal direction of the iron core by disposing the movable iron pieces to confront magnetized faces at opposite sides of said iron core, and contact mechanisms to be driven for opening and closing based on the movement of said movable block, the improvement comprising movable contact pieces of the contact mechanisms fitted into grooves formed in arm portions of said movable base, small projections formed on said movable contact pieces, and recesses which are formed in said grooves and in which said small projections are fitted.

2. An electromagnetic relay as claimed in claim 1, wherein each of said contact mechanisms provided at opposite sides of a base member for the electromagnetic relay one set by one set, includes the movable contact piece fixed at its one end, to a terminal provided at one side on the base member, and a movable contact provided at the other end of the movable contact piece so as to be located between stationary contacts provided on a pair of spaced stationary terminals disposed at the other side on the base member.

* * * * *